United States Patent [19]

Peppel

[11] Patent Number: 4,943,188

[45] Date of Patent: Jul. 24, 1990

[54] ROTATING LUG ANCHOR CONNECTOR

[75] Inventor: George W. Peppel, Arlington, Tex.

[73] Assignee: Lockheed Corporation, Calabasas, Calif.

[21] Appl. No.: 307,053

[22] Filed: Feb. 6, 1989

Related U.S. Application Data

[63] Continuation-in-part of Ser. No. 196,258, May 20, 1988.

[51] Int. Cl.[5] ..... E02D 5/74; F16B 1/04

[52] U.S. Cl. ..... 405/224; 114/294; 403/322; 405/195

[58] Field of Search ..... 405/224, 225, 195, 169, 405/170, 171; 403/322; 114/264, 265, 294; 166/338, 340, 339, 341

[56] References Cited

U.S. PATENT DOCUMENTS 3,766,582 10/1973 Lloyd et al. ..... 405/202
4,591,296 5/1986 Henderson et al. ..... 405/195
4,746,247 5/1988 Arlt et al. ..... 405/224

*Primary Examiner*—Dennis L. Taylor
*Attorney, Agent, or Firm*—Richards, Medlock & Andrews

[57] ABSTRACT

A rotating lug anchor connector (10) is disclosed for anchoring the tether (12) of tension leg platform (14) to the sea floor. The connector includes an anchor latch assembly (18) which is mounted on the lower end of the tether. The assembly includes a ring (50) from which three lugs (58) extend. The ring is secured to the tether through an elastomeric assembly (36) which permits the tether to pivot about a pivot point (28) relative to the ring. Guide surfaces on members (74, 76, 78) of the receptacle assembly (20) guide the lugs downward along vertical slots (104) and beneath notches (92) in the members. Upward movement of the tether engages the lugs and notches to secure the tether to the sea floor. For release the tether is lowered to move the lugs in an alignment with the vertical slots for removal.

10 Claims, 11 Drawing Sheets

ROTATING LUG ANCHOR CONNECTOR

CROSS-REFERENCE TO RELATED APPLICATION

This application is a continuation-in-part of U.S. Pat. application Ser. No. 196,258, filed May 20, 1988.

TECHNICAL FIELD

This invention relates to offshore oil production, and particularly to a connector for the tether of a tension leg platform (TLP).

BACKGROUND OF THE INVENTION

Offshore petroleum drilling and production has become a significant industry worldwide. Many techniques have been developed to achieve what, at first, seemed impossible; the drilling and production of petroleum reserves from beneath the sea floor to a platform on the surface.

One significant design which has found great success in offshore petroleum production is the tension leg platform (TLP). In this design, a platform is literally secured to the sea floor through a number of tethers which extend vertically from the sea floor to the platform floating on the surface. The tethers are kept in tension by the buoyancy of the platform. Tidal motion and wave action are compensated for by lateral movement of the platform and tethers. Vertical movements, normally associated with heave, pitch and roll motions of the sea, are eliminated by the combined buoyancy of the platform and tethers. Typically, latching structure is permanently mounted on the sea floor for receiving the tethers with some mechanism to accommodate pivotal movement of the tethers. The platform is then put in place with the tethers latched to the sea floor structure. The platform can remain in place for many years during drilling and production, but it is anticipated that the platform and tethers will eventually be unlatched from the sea floor mounted latching structure for reuse elsewhere, or scrapping.

Several designs have been proposed for latching mechanisms to secure tethers to the sea floor receptacle mechanisms. One is disclosed in U.S. Pat. No. 4,498,814 issued Feb. 12, 1985 and assigned to Vickers. The design includes a collet configuration with shoulder blocks which are deployed into contact with a mooring sleeve at the sea floor. A flexible joint permits angular or torsional movement of the tether. However, this design requires hydraulic actuation to unlatch the tether. Hydraulic actuation of necessity requires a pressurized hydraulic line to extend from the connector at the sea floor to the surface where the hydraulic pump and control circuitry is situated. The hydraulic line is typically routed through the hollow interior of the tether. If portions of the tether interior are designed to be dry to increase buoyancy, it requires substantial effort to seal the line at the bottom bulkhead perforation at the lower end of the tether. If inspection tools are run through the tether interior, they can foul and damage the hydraulic line going to the connector. This reliance on hydraulic operation creates a question as to the reliability of releasing the connector over the long service life demanded of this type of system. Any seals employed can easily deteriorate and fail over a span which could be as long as 30 years. As the working components of the connector are internal within the latch body and hidden from exterior view, the analysis or identification of any mechanical or hydraulic problems by visual inspection become virtually impossible.

Another design for a TLP connector is disclosed in U.S. Pat. No. 4,439,055, issued Mar. 27, 1984 and assigned on its face to Vetco Offshore, Inc. The design of this patent relies upon a series of latch dogs with attached shoulder blocks. The latch dogs are mounted at the lower end of the tether and are held in the retracted position as the lower end of the tether is stabbed into a cavity in the sea floor mounted structure. Each of the dogs is pivoted to the tether. As the tether is stabbed into the sea floor structure, a running tool releases the dogs to pivot against a receptacle load ring to secure the tether. To release the tether, a release tool is run down the bore of the tether to retract the dogs. The design is incompatible with a tether having a dry interior, since the release tool must move from the surface to the connector within the tether. Again, visual inspection and verification of the latch is difficult.

To add further complications to the connector design, the industry requires a secondary unlatch technique to exist, if the primary unlatching technique fails.

SUMMARY OF THE INVENTION

In accordance with one aspect of the present invention, an anchor connector is provided for releasably securing the tether of a tension leg platform to the sea floor. The anchor includes a first member secured to the sea floor and a second member secured to the lower end of the tether. A ring is provided which has a central vertical axis. The ring has at least one lug, preferably at least three, extending horizontally therefrom along a radius centered on the vertical axis. A cylindrical receptacle is provided which also has a central vertical axis. The receptacle includes a primary guide, a vertical slot, a secondary guide and a notch. The ring is mounted to one of the members, while the cylindrical receptacle is mounted to the other of the members. The ring and receptacle are mounted on the members to permit relative rotation between the ring and receptacle about the central axis of the tendon.

In operation, the tether is lowered vertically until the lug contacts the primary guide. With subsequent lowering of the tether, the primary guide rotates the lug into and along the vertical slot and into contact with the secondary engagement guide. With further downward movement of the tether, the secondary engagement guide will rotate the lug approximately halfway to the notch. Subsequent upward movement of the tether causes the lug to rotate the remaining distance to the notch to engage the notch to secure the tether to the sea floor. During this operation, the tether is only moved vertically, and is not required to rotate or pivot about its central axis. The movement necessary to guide the lug into the notch is completely accommodated by the rotation of the ring and lug.

To release the tether from the sea floor, the tether is again lowered, bringing the lug into engagement with the release guide. With further downward movement of the tether, the release guide rotates the lug approximately halfway to a second vertical slot. Upward movement of the tether rotates the lug the remaining distance and pulls the lug through the second vertical slot and releases the first member from the second member.

In accordance with another aspect of the present invention, the ring is mounted on the second member for rotation about a vertical axis, and has one or more lugs, preferably at least three lugs, spaced uniformly about its outer circumference. The elastomeric element is bonded between the ring and the second member to permit pivotal motion of the tether about a center of rotation lying on the vertical central axis of the tether. The cylindrical receptacle is rigidly secured to the first member and has sufficient primary guides, vertical slots and secondary guides to allow all the lugs to be engaged in notches to secure the tether to the sea floor.

In accordance with another aspect of the present invention, the lugs can be mounted on the first member at the sea floor. The guides, slots and retention notches can be mounted on the second member at the lower end of the tether. In this configuration, either, or both, of the members can mount the rotating structure permitting the lugs to engage and disengage the retention notches.

If desired, multiple rows of lugs can be provided, which interact with multiple rows of notches. Further, the sequence of mounting the elastomeric elements, lugs and notches between the tether and sea floor can be altered as required to suit a specific application.

In the event that fouling occurs which prohibits free rotation of the ring and lugs in relation to its adjoining members, the tether can be released by moving it vertically and permitting the entire tether to rotate and release the tether and latch assembly from the sea floor mounted receptacle assembly. This provides a reliable secondary release mechanism to satisfy this requirement of the industry.

BRIEF DESCRIPTION OF THE DRAWINGS

For a more complete understanding of the present invention, and the advantages thereof, reference is now made to the following description, taken in conjunction with the accompanying drawings, in which.

DETAILED DESCRIPTION

Figure 1:
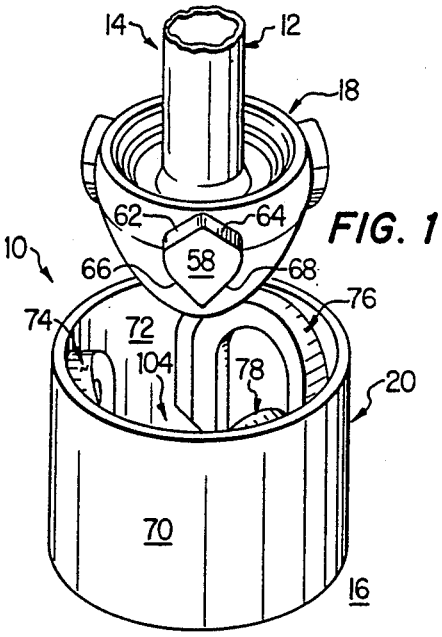
FIG. 1 is a perspective view of a rotating lug anchor connector forming a first embodiment of the present invention.

With reference now to FIG. 1, a rotating lug anchor connector 10 for anchoring a tether 12 of a tension leg platform (TLP) 14 to the sea floor is illustrated. The connector includes an anchor latch assembly 18 which forms the lower end of the tether 12 and a receptacle assembly 20 which is permanently mounted on the sea floor 16.

Figure 2:
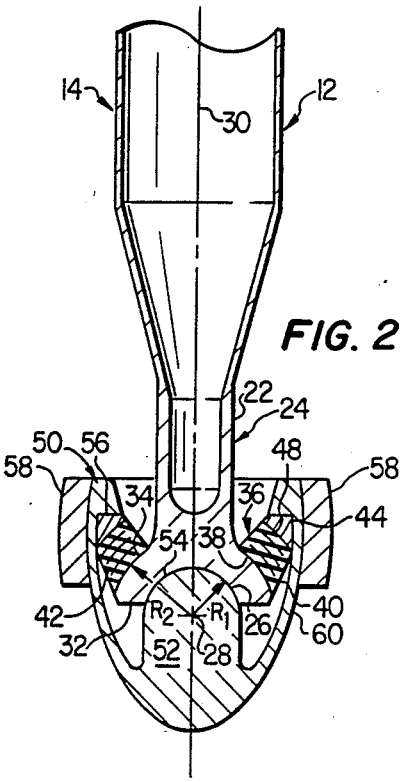
FIG. 2 is a vertical cross sectional view of the latch assembly used in the connector of FIG. 1.

With reference now to FIG. 2, further details of the latch assembly 18 will be described. The latch assembly 18 can be used with any tether design permitting vertical upward and downward movement of the assembly. However, the tether 12 illustrated has a tubular shape with a hollow dry interior which is designed to result in near neutral buoyancy for the tether when installed. For example, the tether may have a main diameter along substantially its whole length of about 40 inches. The tether preferably necks down in portion 22 on which the assembly is secured to reduce the stresses in the tether as it pivots relative to the connector 10 and sea floor 16 (see FIG. 1). For example, the portion 22 can neck down to a final diameter of 27 inches from the diameter specified previously for the main portion of the tether. However, such a neck down or alternate design is generally determined by the overall system design and not by the operation of the present invention.

Secured to the portion 22 is a center shaft 24. The lower end of the shaft 24 ends in a hemispherical concave surface 26 which is formed about a radius $R_1$ centered at point 28 on the vertical axis of symmetry 30 of the tether 12 and latch assembly 18. The surface 26 is formed in part by a flange 32 which defines a semi-spherical surface 34 on its outer surface having a radius of curvature $R_2$ and centered on point 28 as well.

An elastomeric assembly 36 is bonded on its inner surface 38 to the surface 34 of the flange 32. The elastomeric assembly preferably is an assembly of a number of individual elastomeric elements 40 of elastomeric material formed into semi-spherical sections with radii centered on point 28 bonded together to form the assembly 36. If desired, rigid reinforcing elements 42, each being a semi-spherical section having its radius centered on point 28, can be bonded between the elements to reinforce the elastomeric assembly 36. A collar 44 having a semi-spherical inner surface 46 with its radius centered on point 28 is bonded to the outer surface 48 of the elastomeric assembly 36.

A rotating ring 50 is fit around the flange 32 and collar 44, as shown. The ring 50 includes a centering ball 52 with a convex hemi-spherical surface 54 of radius approximately $R_1$ centered on point 28 which may bear against the surface 26 of center shaft 24 to guide pivotal motion between the elements about point 28. The collar 44 contacts a shoulder 56 on the ring 50 to hold the ring on the collar 44, but permits the ring 50 to rotate about the axis 30 relative to the flange 32, and tether 12. Three lugs 58 extend radially outward from the outer surface 60 of the ring on radii extending perpendicular the axis 30. As best seen in FIG. 1, the lugs may have a diamond shape, including upper slanted surfaces 62 and 64 and lower slanted surfaces 66 and 68. The lugs are oriented at equal spacing from each other about the outer surface 60 which, for three lugs, translates to 120 degrees separation between a lug and the adjacent lugs.

Figure 4:
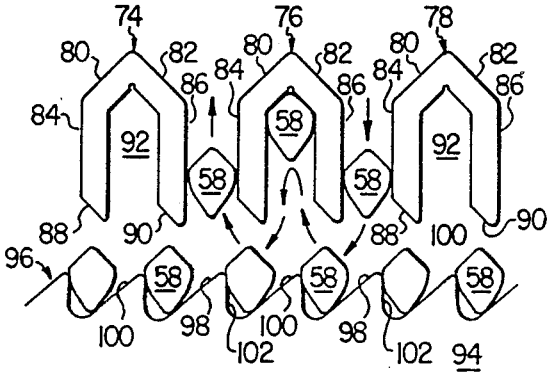
FIG. 4 is a flattened view of the interior configuration of the receptacle assembly.
Figure 3:
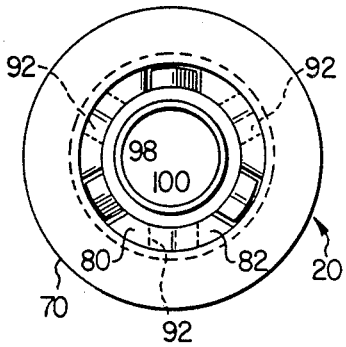
FIG. 3 is a top plan view of the receptacle assembly of FIG. 1.
Figure 5:
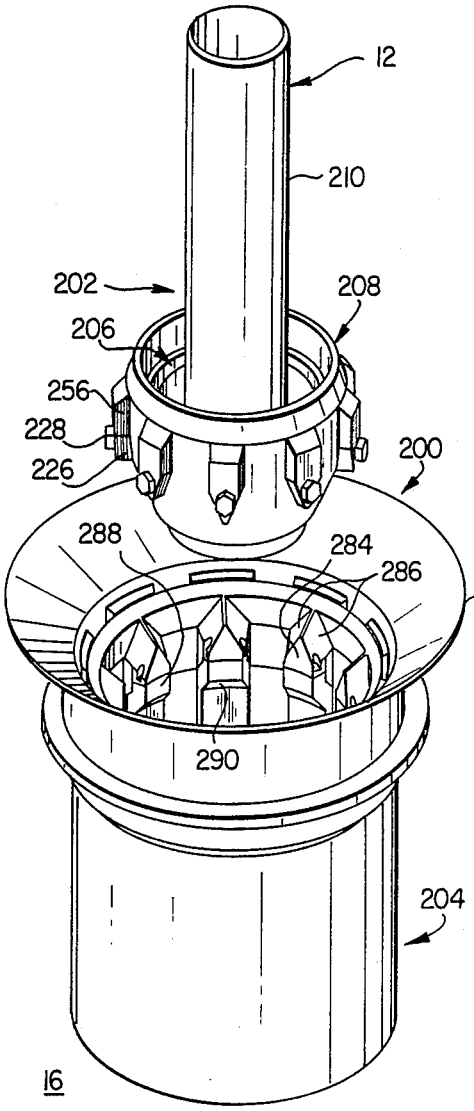
FIG. 5 is a perspective view of a rotating lug anchor connector forming a second embodiment of the present invention.

With reference now to FIGS. 1, 3 and 4, the details of the receptacle of assembly 20 will be described. The assembly 20 includes a cylinder 70 which is rigidly, and permanently mounted to the sea floor 16. The mounting can be made by any acceptable technique. On the interior surface 72 of cylinder 70 are mounted three members 74, 76 and 78. Each member defines slanted primary guide surfaces 80 and 82, side walls 84 and 86, lower slanted surfaces 88 and 90, and a notch 92 in its interior. Spaced underneath the members 74, 76 and 78 is an annular ring 94 which define a series of secondary guide surfaces 96 which alternate between secondary engaging guide surfaces 98 and secondary release guide surfaces 100. Associated with each of the guide surfaces 96 is a facing vertical surface 102 for stopping the rotation of lugs 58 at the proper spacing.

With particular reference to FIG. 4, the operation of the connector can be described. The tether, and anchor latch assembly 18, are lowered proximate with the receptacle assembly 20. At some point, the lugs 58 will enter the opening of cylinder 70 and move into close proximity to the primary guide surfaces 80 and 82. It can be seen that the guide surface 80 of one member and the guide surface 82 of the adjacent guide member cooperate to rotate ring 50 and direct the lugs contacting one of the surfaces into vertical slots 104 defined between the side walls 84 and 86 of the adjacent members.

Each of the three or more lugs 58 will contact one of the surfaces 80 or 82 at about the same time. The lugs then slide downwardly along the surfaces and the ring 50 rotates about the axis 30 to align the lugs with the vertical slots 104. To accommodate the motion, the shoulder 56 will rotate against the collar 44 so that no rotation of the tether is necessary about its vertical axis 30 to engage the connector.

As the tether continues its downward motion, the lower slanted surface 68 of each lug will come into engagement with the secondary engaging guide surface 98 at the bottom of each vertical slot 104. Continued downward movement will cause the ring 50 to rotate about the axis 30 relative to the tether until the lugs impact against stops 102. At this point, the tether can not move any further downward. At the surface, the stoppage of the downward movement of the tether provides the signal to raise the tether to perform the final steps of engaging the latch assembly within the receptacle assembly. As the tether is raised, the upper slanted surface 64 of each lug will engage the surface 90 of a member and rotate the ring about axis 30 sufficiently to align each lug with a notch 92 to secure each lug within a notch to complete the connection. The tension in the tether 12 caused by the buoyancy of the platform will hold the lugs within notches 92.

Once connected, wave and tidal action acting on the platform can be accommodated by pivotal motion of the tether 12 about the pivot point 28 permitted by the deflection of the elastomeric assembly 36. In a typical application, multiple tethers and connectors will be employed for each platform.

When it becomes necessary to disconnect tether 12 from the assembly 20, whether for inspection, maintenance or removal of the platform from the site, the tether 12 is moved downwardly so that each lug contacts a secondary release guide surface 100. Further downward movement of the tether will cause the lugs to slide down surfaces 100, with the ring 50 again rotating relative to the tether about the axis 30 until the lug motion is halted by the stops 102 facing the surfaces 100. The cessation of movement is again sensed at the surface, and provides the signal to begin raising the tether.

As the tether is raised, the surfaces 64 on the lug 58 contact the surfaces 88 on each of the members 74, 76 and 78 to rotate the ring 50 and allow the lugs to move up through the vertical slots 104 to disconnect the anchor latch assembly 18 from the receptacle assembly 20.

If a remote operated submersible vehicle (R.O.V.) is available, the tether and receptacle assembly can be marked with various axial and circumferential markings viewable by the R.O.V. to monitor the latching and unlatching operation. For example, proper insertion of the tether into the receptacle assembly can be assisted and confirmed by the R.O.V. by providing axial marks on the tether and receptacle assembly which move into alignment upon proper insertion of the tether. The R.O.V. can also be used to assist and confirm relative axial motion of the ring 50 and receptacle assembly to various axial function points by alignment of circumferential marks on the tether and receptacle assembly.

One significant advantage of the present invention over prior designs is the ability to provide a reliable secondary release mechanism. As noted previously, in normal operation, the tether 12 need never be rotated about its vertical axis in latching or unlatching the tether. The rotation necessary to engage lugs 58 with the notches 92, and subsequently disengage those lugs, is accommodated by rotation of the ring 50 relative to the tether. However, should normal operation of the connector be impossible, due to corrosion, damage or other factor, the lugs can be moved relative to members 74, 76 and 78 by making provisions to rotate the tether 12 about its vertical axis 30 and disengage the lugs from the notches.

While three lugs 58 and cooperating notches 92 are illustrated in the FIGURES and described above, it will be clear that the advantages of the present invention can be realized by using a greater or lesser number of cooperating lugs and notches.

While the lugs have been shown to have a diamond shape, any other shape which cooperates with the guide surfaces and notches could be used. For example, the lugs can have a round configuration. It is preferred to shape the notches and the notch engaging surfaces of the lugs similarly to distribute the forces transferred between the lugs and notches as uniformly as possible.

Further, the lugs have been illustrated as being elastically mounted to the lower end of the tether. However, the lugs can be mounted permanently on the sea floor either within cylinder 70, or mounted on other structure, and members 74, 76 and 78 elastically secured at the lower end of the tether to cooperate with the lugs in substantially the same manner. In such a configuration, either the lugs, or members 74, 76, and 78 can be mounted for rotation about axis 30. In fact, the lugs and members 74, 76 and 78 can all be mounted for rotation about axis 30. If desirable, the elastomeric assembly can form part of the permanent sea floor installation and connected to the associated members or lugs as desired.

In the figures, and the description above, only one row of lugs and notches have been used. However, it could be desirable to use multiple rows of lugs and notches to provide greater force transferring capability. In such a design, the cylinder 70 could be extended in height to mount multiple rows of members 74, 76 and 78, stacked in vertical rows, but defining common vertical slots. The ring could mount multiple rows of lugs, with each lug in one row stacked vertically above or below a corresponding lug in the adjacent row. The members 74, 76 and 78 would be stacked sufficiently apart vertically so that a lug in a given row could rotate between surface 90 of a given member and the surface 82 of the member below it to engage the notch in the given member. In this design, the lowest row of lugs would contact the uppermost members 74, 76 and 78 to orient the ring and lugs into alignment with the vertical slots. As the lugs move downward, the lowest row of lugs would engage surfaces 98 to rotate the lugs in all rows into alignment with the notches designed to receive them. Upward vertical motion of the tether would then engage all lugs simultaneously with their associated notches. In disengaging the lugs, the surface 68 of each lug and surface 80 of the member just below it could engage simultaneously with the lowest row of lugs engaging surface 100 to align the lugs for removal.

With reference now to FIGS. 5–13, a rotating lug anchor connector 200, forming a second embodiment of the present invention, is illustrated. Again, the connector 200 is intended to secure the tether 12 of a TLP to a structure, or tendon foundation template (TFT) on the sea floor 16 while accommodating motion of the tether even as much as 10° C. from vertical. As with connector 10, connector 200 includes a latch assembly 202 forming a portion of the tether 12, and a receptacle assembly 204, attached to the TFT.

Figure 9:
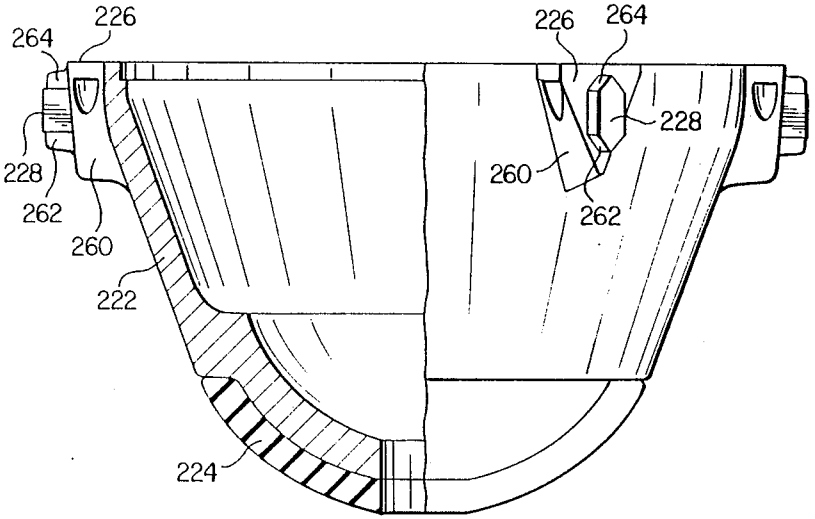
FIG. 9 is a detailed view of the latch assembly.
Figure 10:
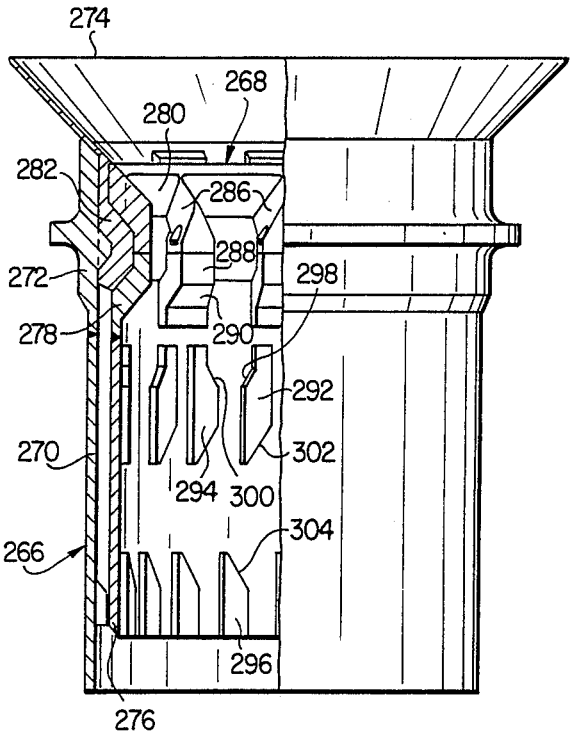
FIG. 10 is a view of the receptacle assembly.
Figure 8:
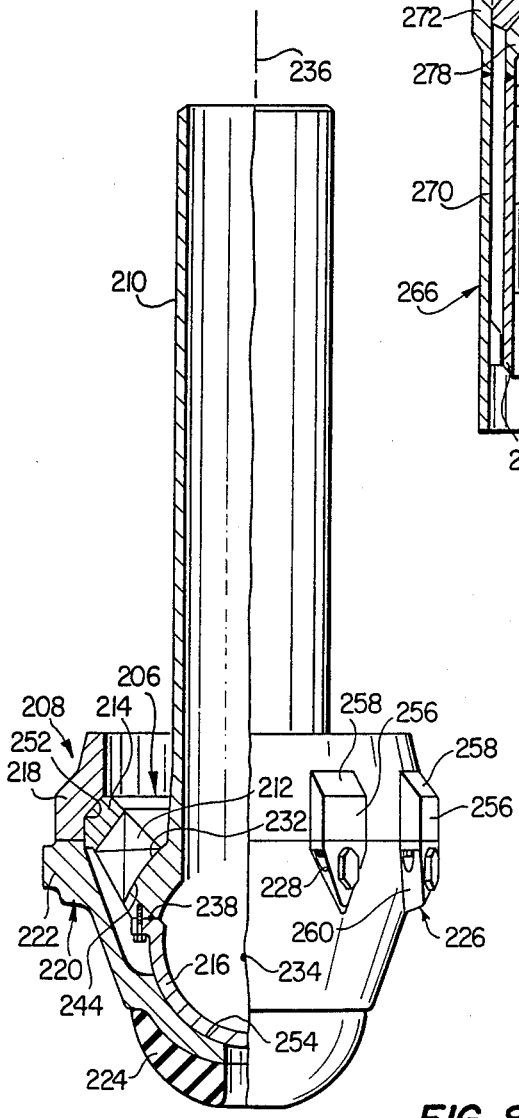
FIG. 8 is a vertical cross-sectional view of the latch assembly of the connector.
Figure 14:
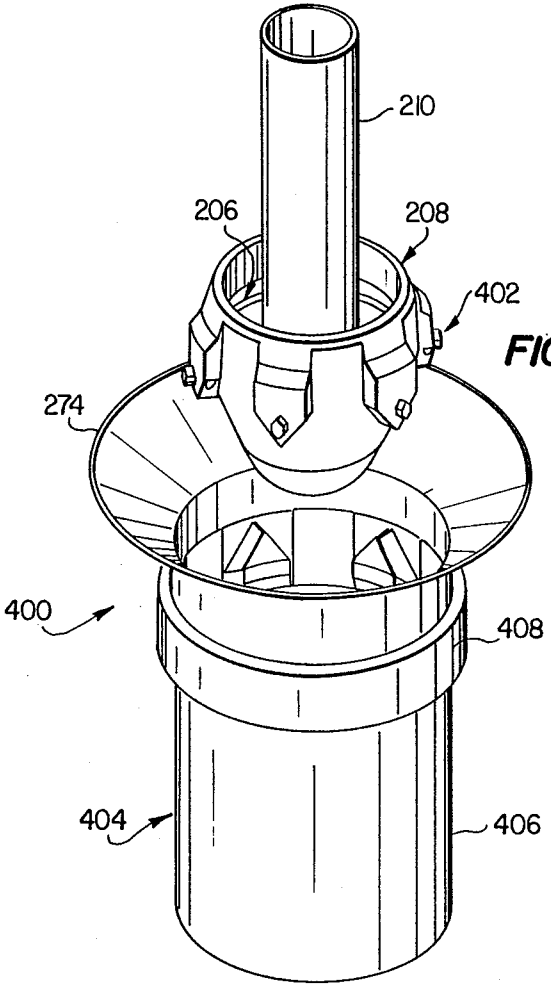
FIG. 14 is a perspective view of a rotating lug anchor connector forming a third embodiment of the present invention.

With reference to FIGS. 8 and 9, the latch assembly 202 includes two major subassemblies, flex joint assembly 206 and connector assembly 208. The flex joint assembly 206 includes a tether extension 210, a flex element 212, a back flange 214 and a centering ball and bulkhead assembly 216. The connector assembly 208 includes a connector load ring 218 and a housing 220. Housing 220, in turn, is formed of a structural shell 222, a protective shroud 224, entry lugs 226 and actuation lugs 228.

The tether extension 210 is secured to the lower end of the tether 12 as by welding, and preferably essentially forms a continuation of the tether, ending in an upset mushroom or bell shaped mouth 230 defining an exterior spherical surface 232 of radius centered at point 234 along the axis 236 of symmetry of the latch assembly. The centering ball and bulkhead assembly 216 is bolted at the lower end of mouth 230 with a seal 238 between the assembly and mouth to permit the interior of the tether extension 210, and tether 12, to be dry. The spherical portion of assembly 216 also has a radius centered on point 234.

The flex element 212 is essentially identical to elastomeric assembly 36. Flex element 212 is formed of a laminated structure of spherically shaped layers of elastomeric material 240, and rigid reinforcing elements 242 of semi-spherical section, all with radii centered at point 234. The inner surface 244 of flex element 212 is a spherical surface mating with surface 232 of mouth 230 and bonded thereto.

The back flange 214 defines an inner spherical surface 246 which mates with and is bonded to the outer spherical surface 248 of the flex element 212. Back flange 214 further defines a conical section face 250. The tether extension 210, flex element 212 and back flange 214 thus form an integral molded component.

The load ring 218 of connector 208 has an inner conical section face 252 which contacts face 250 of back flange 214. The shell 222 of housing 200 defines an interior spherical surface 254 which is in contact with the exterior of the centering ball and bulkhead assembly 216. With load ring 218 secured to housing 220, the connector assembly 208 is mounted to and captures therein the flex joint assembly 206 so that the tether 12 and tether extension 210 can pivot about point 234 relative to the connector assembly 208 and the connector assembly 208 can rotate relative to the flex joint assembly generally about the axis 236. As tether 12 and tether extension 210 pivot about point 234, the spherical mating surfaces of assembly 216 and shell 222 slide relative each other.

With references to FIGS. 8 and 9, the load ring 218 can be seen to have a series of load lugs 256 extending outwardly in radial directions, with each load lug defining an upwardly facing wedge surface 258. The entry lugs 226 on the exterior of the shell 222 essentially form extensions of the load lugs 256 when shell 222 is secured to load ring 218, and form downwardly converging side surfaces 260. An actuation lug 228 extends radially outward from the outer surface of each entry lug. The actuation lugs 228 have a diamond shape with downwardly converging surfaces 262 and upwardly converging surfaces 264. The protection shroud 224 can be formed of an elastomeric material, such as rubber, and acts to cushion the impact of the latch assembly against the receptacle assembly.

With reference now to FIGS. 10–13, the construction of the receptacle assembly 204 will be more fully described. The receptacle assembly 204 includes a sea floor mounted structure 266 and a receptacle body 268. The structure 266 includes a cylinder 270 mounted to the sea floor, a load ring 272 and an entry cone 274. The receptacle body 268 includes a tube structure 276, a receptacle load ring 278, a receptacle retainer ring 280 and a secondary release ring 282. Normally, the structure 266 and body 268 will be integral. However, the secondary release ring 282 permits the release of body 268 from structure 266 in an emergency to provide a secondary release mechanism to separate the tether from the sea floor.

Figure 11A:
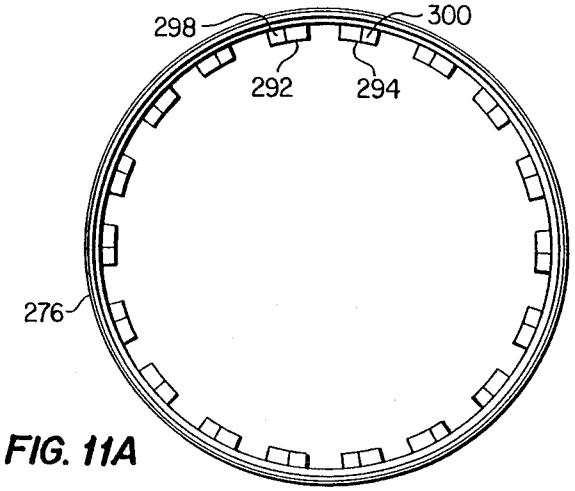
FIGURE 11A is a plan view of the tube structure of the receptacle assembly.
Figure 11B:
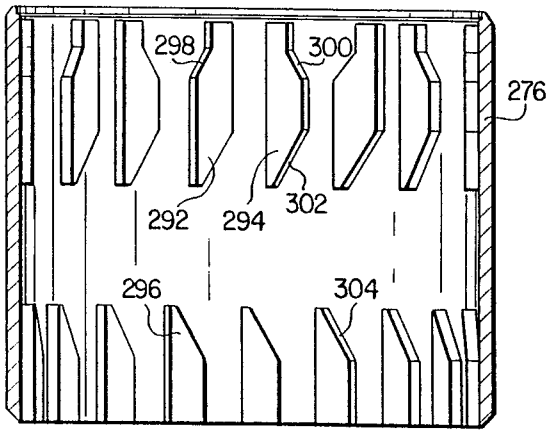
FIGURE 11B is a vertical cross-sectional view of the tube structure.

The receptacle retainer ring 280 has a series of radially inwardly and downwardly extending entry lugs 284 with upwardly and inwardly converging surfaces 286. The retainer ring 280 is bolted atop the load ring 278 which, in turn, defines radially inward extending load lugs 288 which define a continuation of the entry lugs 284. Each load lug 288 defines a downwardly facing wedge surface 290. The load ring 278 is, in turn, secured atop the tube structure 276. From the interior surface of the tube structure 276 are formed inwardly radially extending upper guide vanes 292 and 294 and lower guide vanes 296, as best seen in FIGURES 11A and 11B. Vanes 292 and 294 have oppositely facing guide surfaces 298 and 300, respectively. Each vane 292 and 294 has a downwardly facing guide surface 302. Each guide vane 296 has an upwardly facing guide surface 304.

Figure 12A:
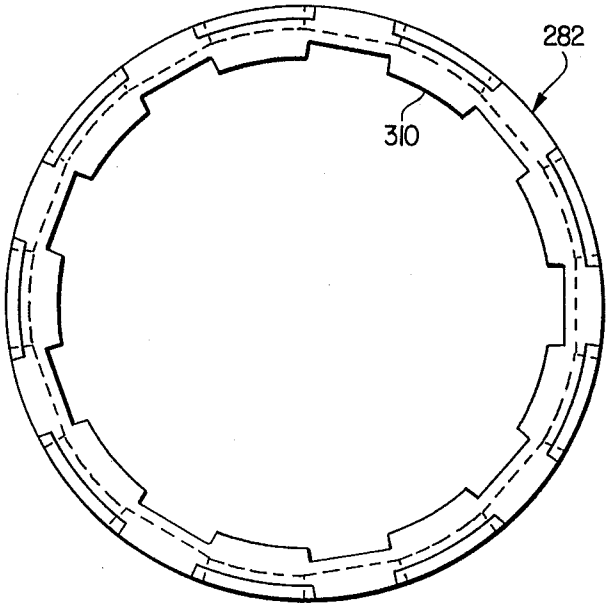
FIG. 12A is a plan view of the secondary release ring.
Figure 12B:
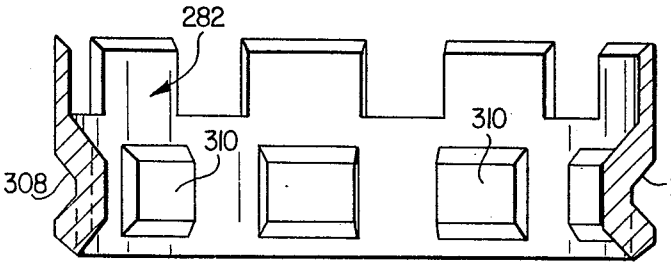
FIG. 12B is a vertical cross-sectional view of the secondary release ring.
Figure 13B:
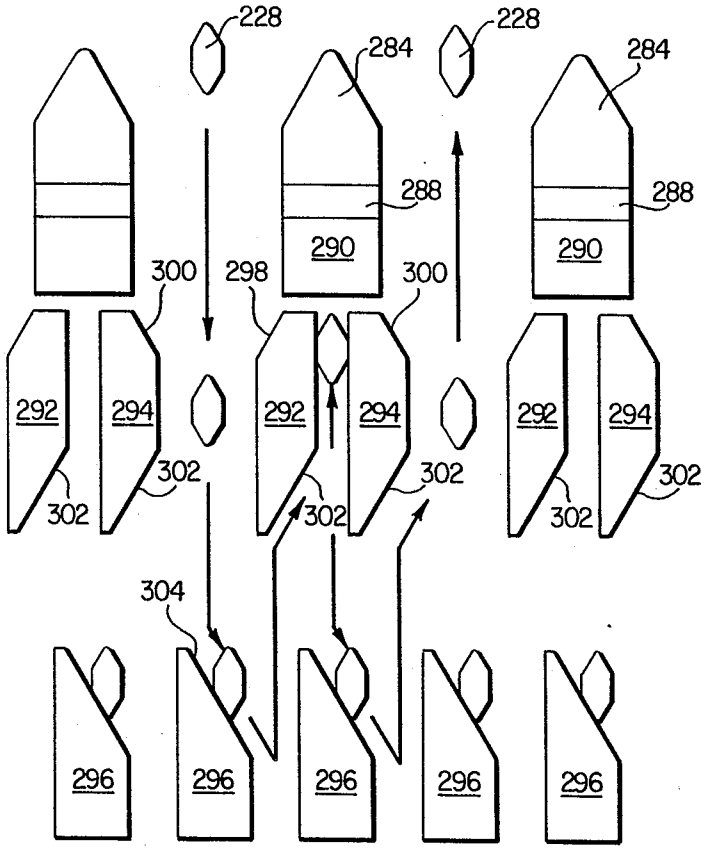
FIG. 13B is a flattened view of the interior configuration of the receptacle assembly.
Figure 13A:
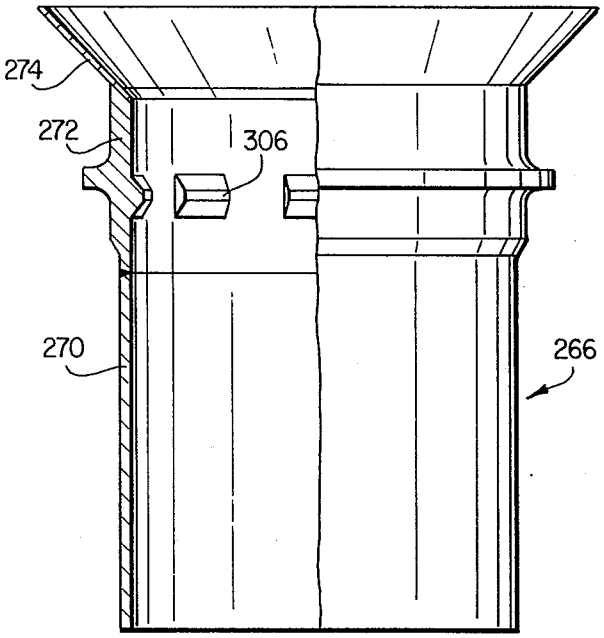
FIG. 13A is a partial cross-sectional view of the receptacle assembly.
Figure 15:
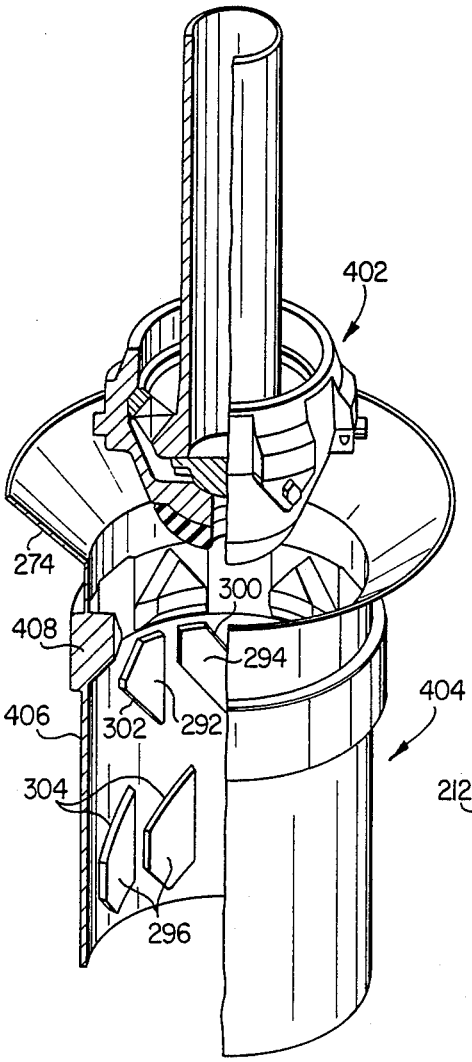
FIG. 15 is a perspective view in partial cross-section of the connector.
Figure 16:
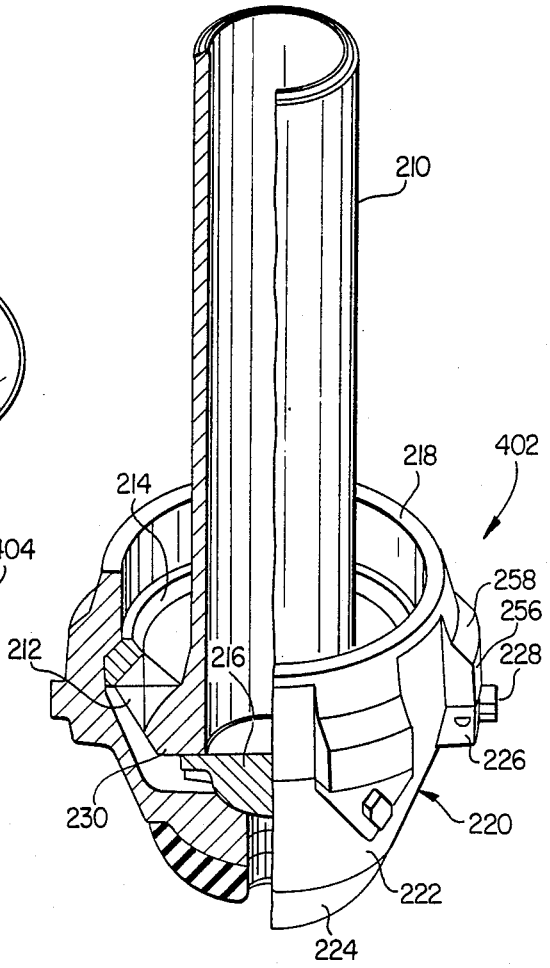
FIGURE 16 is a perspective view in partial cross-section of the latch assembly.
Figure 18:
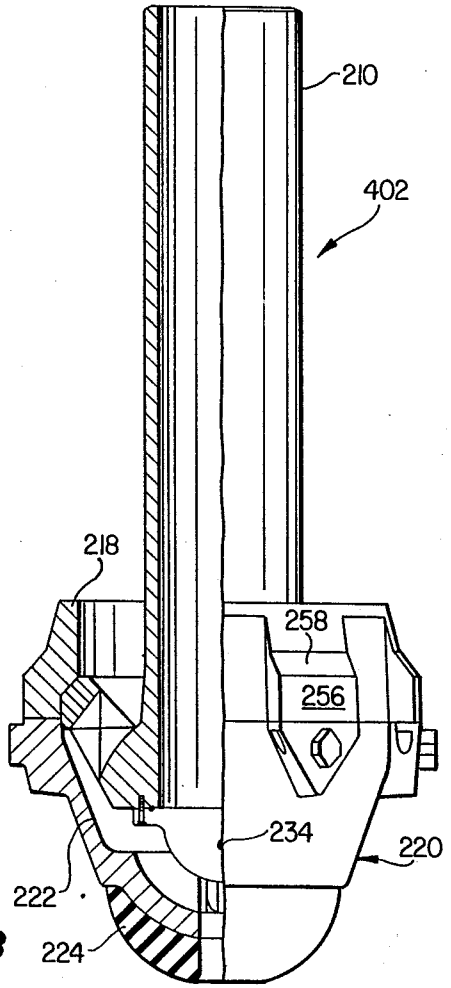
FIG. 18 is a vertical partial cross-sectional view of the latch assembly.
Figure 17:
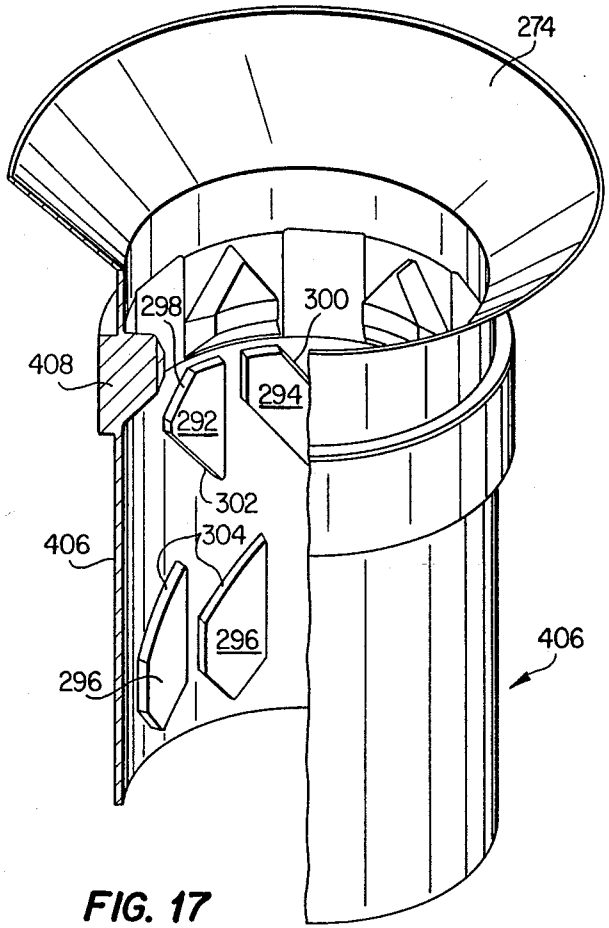
FIG. 17 is a perspective view in partial cross-section of the receptacle assembly.
Figure 20:
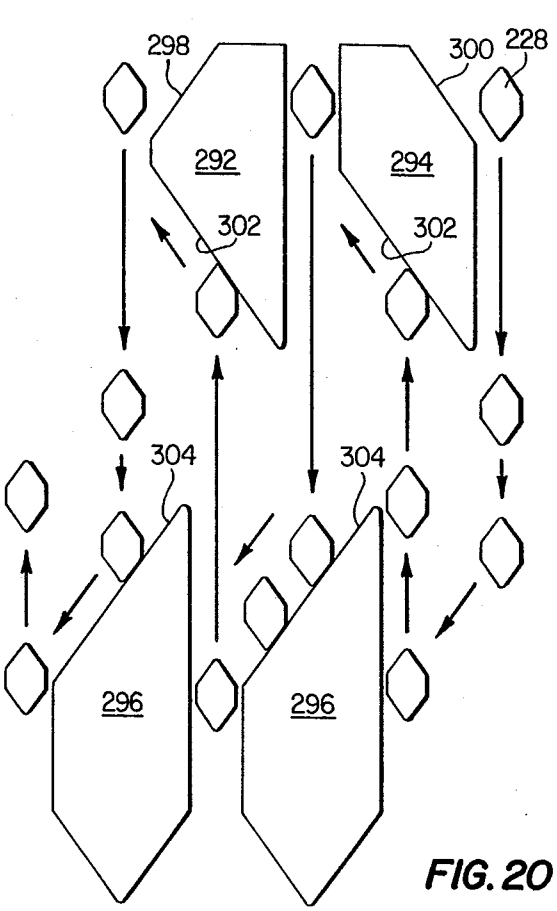
FIG. 20 is a flattened view of a portion of the interior configuration of the receptacle assembly.
Figure 19:
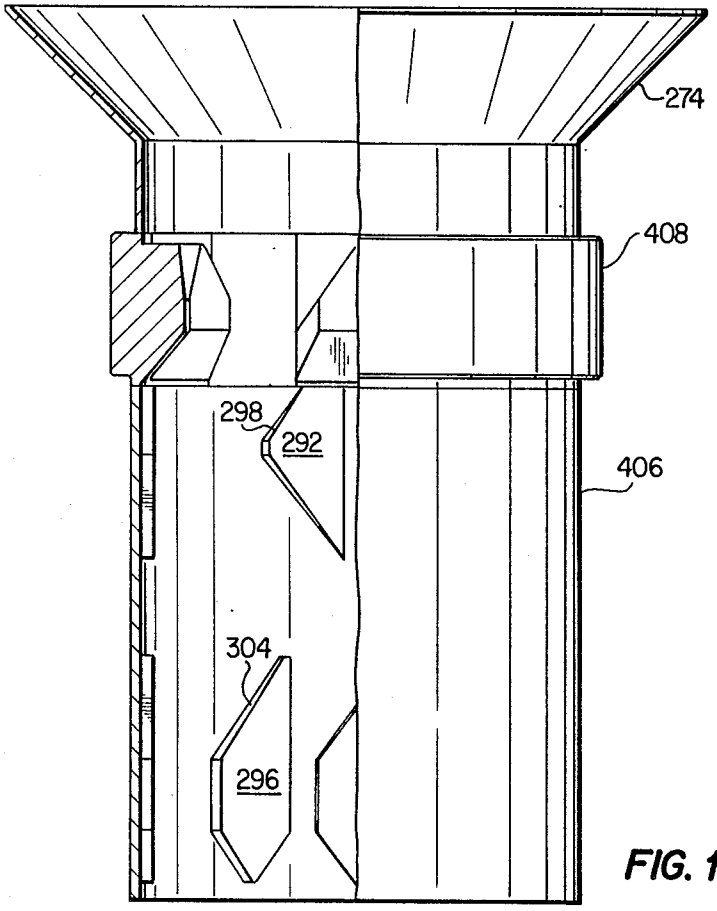
FIG. 19 is a vertical partial cross-sectional view of the receptacle assembly.
Figure 21A:
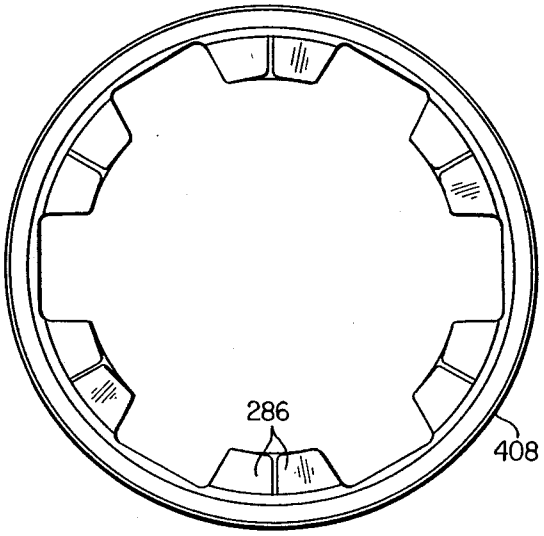
FIG. 21A is a plan view of the receptacle load ring.
Figure 21B:
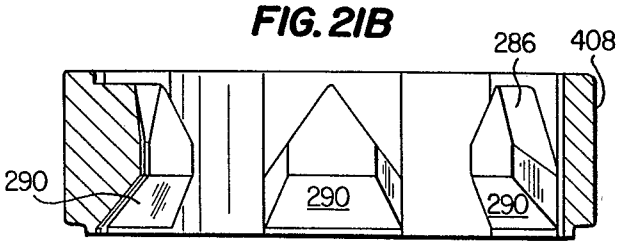
FIG. 21B is a vertical cross-sectional view of the receptacle load ring.

As seen in FIGS. 12A, 12B and 13, the secondary release ring 282 is normally fixed within the structure 266 by inwardly extending lugs 306 on the load ring 272 received within groove 308 on the outer surface of ring 282. Load ring 278 is also typically held in place relative to the ring 282 by radially inward extending lugs 310 extending into notches 312 on the load ring 278.

Figure 7:
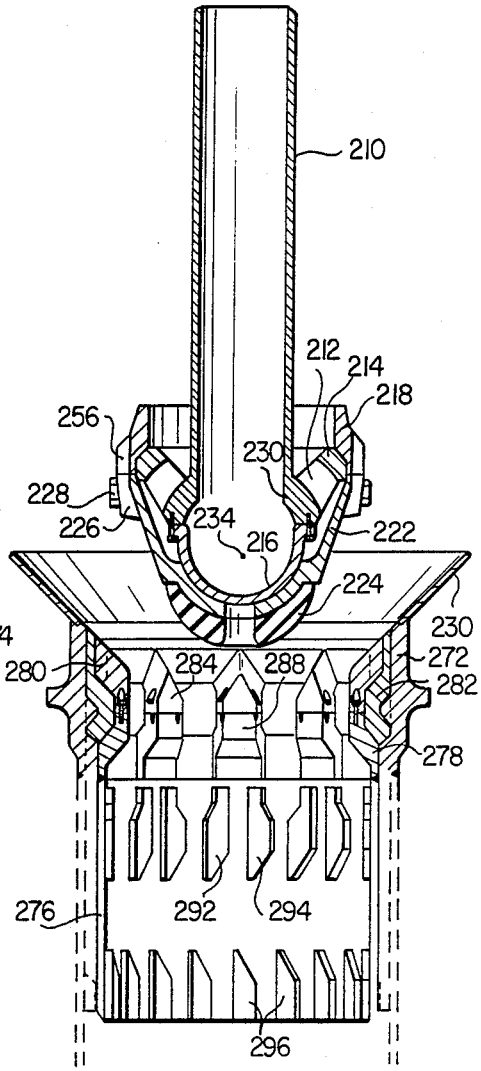
FIG. 7 is a vertical cross-sectional view of the connector of FIG. 5.
Figure 6:
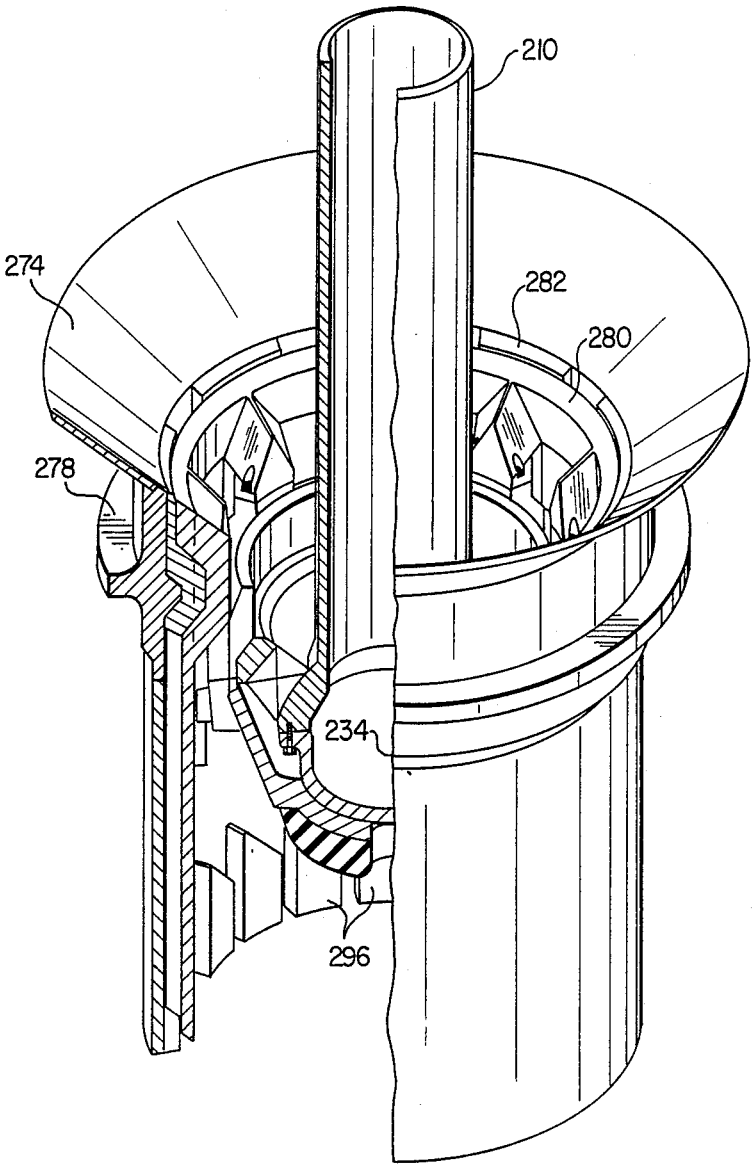
FIG. 6 is a partial cutaway perspective view of the connector of FIG. 5.

In operation, the latch assembly 202 is lowered toward the receptacle assembly 204. The entry cone 274 will help guide the latch assembly 202 into a position where the entry lugs 226 and 284 of the latch assembly and receptacle assembly move into contact. As can be seen in FIG. 7, the edges of entry lugs 284 where surfaces 286 converge form a continuation of entry cone 274 to assist positioning. The converging surfaces of the entry lugs will rotate the connector assembly 208 relative the axis 236 and permit the latch assembly 202 to slide into the interior of the tube structure 276.

As the latch assembly 202 is lowered therein, the actuation lugs 228 will either contact guide surfaces 298, guide surfaces 300, or pass between the two guide surfaces of adjoining upper guide vanes to more precisely orient the connector assembly 208 relative to the receptacle assembly 204 (see FIG. 13B). As the latch assembly 202 continues to be lowered, eventually the actuation lugs 228 will move into contact with guide surfaces 304 on the lower guide vanes 296 to rotate the actuation lugs 228 (and of course connector assembly 208) underneath upper guide vanes 294. The downward motion of the latch assembly 202 will shortly thereafter be halted. Vertical through slots between lower guide vanes 296 prevent latch assembly from bottoming out within the receptacle assembly and putting the tether in compression.

The latch assembly 202 is thereafter raised vertically, which will bring actuation lugs 228 into contact with guide surfaces 302 on vanes 294 and will further rotate the connector assembly 208 until the upwardly facing wedge surfaces 258 are directly beneath the downwardly facing wedge surfaces 290. As the latch assembly 202 is further lifted, the wedge surfaces 258 and 290 come into contact, supporting the tether 12 at the sea floor.

To release the latch assembly 202, the latch assembly 202 need only be lowered until the actuation lugs 228 again contact guide surfaces 304 to further rotate the connector assembly. When the latch assembly 202 bottoms out in the receptacle assembly, the latch assembly 202 is lifted so that the actuation lugs 228 come into contact with guide surfaces 302 on guides 292 to further rotate the connector assembly 208 to an orientation to permit the latch assembly 202 to be lifted out of the receptacle assembly 204.

One advantage of the rotating lug anchor connector 200 is the separation of the structure for orienting the latch assembly 202 relative to receptacle assembly 204, and the load carrying structure. Thus, the orientation structure, such as entry lugs 226, actuator lugs 228 and the guide vanes 292, 294 and 296 need only be designed to absorb forces sufficient to rotate the connector assembly 208 to latch and unlatch the latch assembly 202 from the receptacle assembly 204. The wedge surfaces 258 and 290 carry the load of the connector.

In addition, as the load carrying lug need not be pointed, i.e., with converging surfaces to provided an orientation function, the load stress can be better distributed over the mating lugs by providing an area loaded design which lends itself to less expensive manufacturing techniques while providing a more stable load path and assuring simultaneous, even loading of all load path interface points. Also, by separating the load and orientation functions, the load lugs can be sloped compression loaded shoulder block elements at the top of the loading ring, rather than the cantilevered configuration of a lug used for orientation function. The location and geometry (sloped faces) of the load lugs assures a stable load path by carrying most of the load in compression rather than shear, by placing the interface of surfaces 258 and 290 in a plane perpendicular to the load path, and by aligning the load path with the center of the flex element.

A further dedication in function exists between the entry lugs which provide gross positioning of the latch assembly and will therefore be subject to severe wear and damage, and the actuation lugs and guide vanes, which provide more precise positioning, with less wear or damage risk.

As the tether is usually maintained in tension, a primary load transfer path is defined in the connection, transferring forces from tether extension 210, through flex element 212 to back flange 214. The load is transferred from conical face 250 of back flange 214 to conical face 252 of load ring 278. From load ring 278 the load is transferred to ring 282, load ring 272 and thus to the TFT. The non-load transferring components of connector 200 can be made in less expensive processes such as casting to reduce the cost of the connector, while forging only the elements in the load path. For example, tube structure 276 can be cast with integral guides 292, 294 and 296.

As can be seen in connector 200, nine load lugs 256 and 288 are provided, each spaced uniformly at 40° C. angles from the adjacent lugs. Thus, each time the latch assembly 202 is raised or lowered into the receptacle assembly, the various actuation structure rotates the connector assembly 20° C. relative to the receptacle assembly and tether 12. The guide surfaces 298–304 are preferably designed with an incline of 60° C. from horizontal. If desired, a receptacle cover can be used to cover the opening into the interior of the receptacle assembly 204 prior to insertion of a latch assembly 202, to prevent debris from falling into the receptacle assembly.

With reference now to FIGS. 14–21, a rotating lug anchor connector 400 forming a third embodiment of the present invention is illustrated. The rotating lug anchor connector again includes a latch assembly 402 which is received within a receptacle assembly 404 in the manner of connectors 10 and 200. The latch assembly 402 is essentially identical to latch assembly 202 and the various elements thereof are identified by the same reference numerals as in latch 202, with the exception that the latch assembly 402 has only six entry lugs 226, actuation lugs 228 and load lugs 256, spaced at 60° angles relative to each other.

Figure 22A:
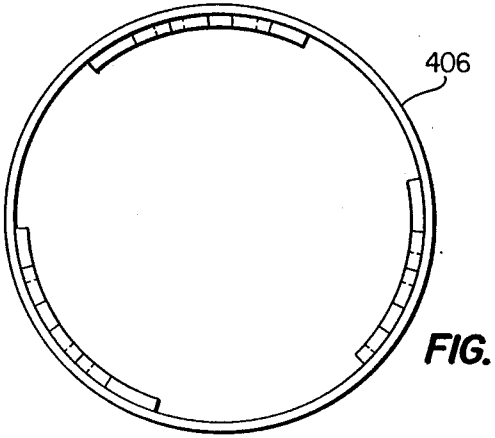
FIG. 22A is a plan view of the receptacle body.
Figure 22B:
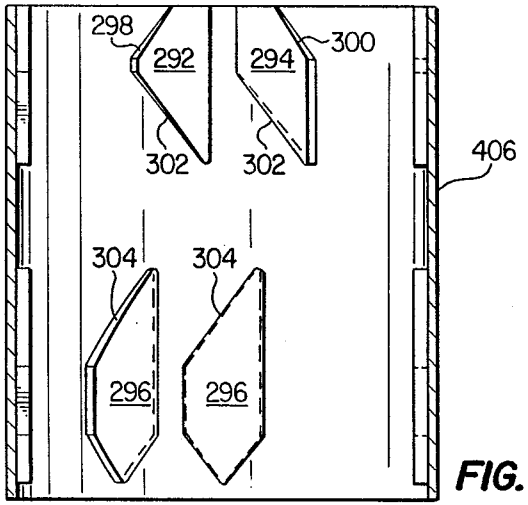
FIG. 22B is a vertical cross-sectional view of the receptacle body.

The receptacle assembly 404 is similar in many respects to the receptacle assembly 204, and those similar elements are identified by the same reference numerals as used previously for receptacle assembly 204. However, receptacle assembly 404 does not incorporate a secondary release mechanism. Thus, receptacle assembly 404 includes only a receptacle body 406, a receptacle load ring 408 mounted to body 406 and entry cone 274. In the load ring 408, single lugs 410 perform the function of the cooperating entry lugs 284 and load lugs 288 of receptacle assembly 204. Also, only three sets of upper guide vanes 292 and 294 are used, even though six load lugs 410 are employed (see FIGS. 22A and 22B). This emphasizes the flexibility of separating load carrying and orientation functions. For example, six load lugs may be required to transfer the loads imposed on the connectors, while only three of the actuation lugs 228 are actively used for each latching or unlatching effort.

While several embodiments of the present invention have been illustrated in the accompanying drawings, and described in the foregoing Detailed Description, it will be understood that the invention is not limited to the embodiments disclosed, but is capable of numerous rearrangements, modifications and substitutions of parts and elements without departing from the spirit of the invention.

I claim:

1. A connector for releasably securing the tether of a tension leg platform to the sea floor, comprising:

a first member secured to the sea floor;

a second member secured to the lower end of the tether;

a ring having a central vertical axis, said ring having at least one load lug and at least one actuation lug, each lug extending horizontally from the ring along a radius centered on the vertical axis;

a cylindrical receptacle having a central vertical axis, said cylindrical receptacle having at least one load lug, at least a first and second upper guide and at least one lower guide, a vertical slot being formed between said upper and lower guides;

the ring being attached to one of said members and the cylindrical receptacle attached to the other of said members, the attachment of a selected one of said ring and cylindrical receptacle to the associated member permitting rotation of said selected one about the vertical axis relative to the associated member; and the lowering of the tether causing the actuation lug to contact the first upper guide, subsequent lowering of the tether causing the first upper guide to guide the actuation lug into and along the vertical slot and into contact with the lower guide, the lower guide guiding the actuation lug to position the actuation lug under the second upper guide, upward movement of the tether engaging the actuation lug and second upper guide to guide the load lug on the ring under the load lug on the cylindrical receptacle to secure the tether to the sea floor.

2. The connector of claim 1 wherein a selected one of said ring and cylindrical receptacle, and associated member, are connected by an elastomeric assembly permitting pivotal motion of the tether about a pivot point centered on the vertical axis of the tether.

3. The connector of claim 1 wherein six load lugs extend from the ring spaced uniformly apart about the ring, the cylindrical receptacle including six load lugs, each load lug on the cylindrical receptacle for mating with a load lug on the ring.

4. The connector of claim 1 wherein nine load lugs extend from the ring spaced uniformly apart about the ring, the cylindrical receptacle including nine load lugs, each load lug on the cylindrical receptacle for mating with a load lug on the ring.

5. The connector of claim 1 wherein the actuation lug extends from the load lug.

6. The connector of claim 1 wherein the cylindrical receptacle further includes a second lower guide, lowering of the tether causing the actuation lug to contact the second lower guide and rotate the actuation lug about the central vertical axis beneath an upper guide, subsequent upper movement of the tether causing said actuation lug to contact the upper guide and rotate about the central vertical axis to release the tether.

7. The connector of claim 1 wherein the mating load lugs include mating wedge surfaces.

8. The connector of claim 1 wherein the ring is attached to the second member, the second member including a tether extension, a flex element, and a back flange, the ring being attached to the back flange, the ring including a load ring.

9. The connector of claim 8 wherein the second member further includes a centering ball and bulkhead mounted on the tether extension, said ring having a housing mounted to the load ring and cooperating with the centering ball and bulkhead to facilitate pivotal motion between the second member and ring about a point.

10. The connector of claim 1 wherein the ring further has at least one entry lug, said cylindrical receptacle having at least one entry lug, said entry lugs providing initial orientation of the ring relative to the cylindrical receptacle to permit the actuation lug to contact the upper guide.

* * * * *